US006640409B2

(12) United States Patent
Sharkness et al.

(10) Patent No.: US 6,640,409 B2
(45) Date of Patent: Nov. 4, 2003

(54) METHOD FOR RETROFITTING A SWING DAMPING VALVE CIRCUIT TO A WORK VEHICLE

(75) Inventors: Eric Sharkness, Troy, MI (US); Dennis Heyne, Burlington, IA (US); Richard J. Lech, Burlington, IA (US)

(73) Assignee: Case Corporation, Racine, WI (US)

( * ) Notice: Subject to any disclaimer, the term of this patent is extended or adjusted under 35 U.S.C. 154(b) by 87 days.

(21) Appl. No.: 09/962,818

(22) Filed: Sep. 25, 2001

(65) Prior Publication Data

US 2003/0056353 A1 Mar. 27, 2003

(51) Int. Cl.[7] ..... B23P 23/00
(52) U.S. Cl. ..... 29/401.1; 91/420
(58) Field of Search ..... 29/401.1, 401, 29/402.01, 402.03, 402.08, 402.14, 890.121, 890.124, 890.12, 407.09, 407.1; 414/221; 214/138 D; 91/420, 454, 412

(56) References Cited

U.S. PATENT DOCUMENTS 3,490,606 A * 1/1970 Gordon ..... 212/282
4,065,010 A * 12/1977 Worback ..... 414/694
4,586,332 A * 5/1986 Schexnayder ..... 60/468
4,628,690 A * 12/1986 Arai et al. ..... 60/464
5,025,626 A * 6/1991 Crosser et al. ..... 60/460
5,048,296 A * 9/1991 Sunamura et al. ..... 60/468
5,259,293 A * 11/1993 Brunner ..... 91/420
5,471,908 A * 12/1995 Lech ..... 91/516
5,609,088 A * 3/1997 Park ..... 91/420
5,897,287 A * 4/1999 Berger et al. ..... 414/699

* cited by examiner

*Primary Examiner*—Gregory Vidovich
*Assistant Examiner*—Stephen Kenny
(74) *Attorney, Agent, or Firm*—John William Stader; Rebecca L. Henkel

(57) ABSTRACT

A method for retrofitting a swing damping circuit to a work vehicle such as a backhoe includes disconnecting a boom swing valve from a boom swing cylinder, and coupling the swing damping circuit to the boom swing valve. Alternatively, it may include replacing a boom swing valve with a combined boom swing valve and swing damping circuit that form a unitary valve body.

23 Claims, 9 Drawing Sheets

METHOD FOR RETROFITTING A SWING DAMPING VALVE CIRCUIT TO A WORK VEHICLE

FIELD OF THE INVENTION

The invention relates generally to methods for retrofitting existing work vehicles for improved performance. More particularly, it relates to method for retrofitting the hydraulic system of a backhoe with a swing damping circuit for damping the unwanted oscillation of the backhoe assembly.

BACKGROUND OF THE INVENTION

Backhoes and other work vehicles have jointed arms that pivot about a vertical axis to position a tool, typically a bucket or similar excavation device. These vehicles are typically engaged in repetitive movement, from side-to-side, picking up a bucket of soil, for example, pivoting to the side, and dumping the bucket of soil, only to return to their original location and begin the process again.

One of the continuing weaknesses of these vehicles is their inability to rapidly position the arm, and hence the bucket, in position over the digging site. When the arm is pivoted and stopped, the sudden closing of the directional control valve that controls flow to and from the boom swing cylinder causes the arm to oscillate side-to-side for some seconds before coming to a complete stop. This oscillation causes delay. Each cycle of scooping and dumping includes the time required to wait for the bucket to stop oscillating.

Co-pending U.S. patent application Ser. No. 09/661,348, describes a circuit that stops this oscillation when attached to a backhoe or other device. Generally speaking, the circuit connects the two hydraulic lines that extend from the directional control valve to the actuator or actuators that actually cause the boom to swing side-to-side. The circuit senses the deceleration of the backhoe arm based upon the various pressures and fluid flows through the two hydraulic lines, then opens a bypass passageway between the two hydraulic lines to permit fluid to flow from one line to the other. Hydraulic fluid is thereby permitted to escape a high-pressure port of the hydraulic actuator and be conducted to a low-pressure port of the hydraulic actuator.

It has been discovered that this circuit (called a "swing-damping circuit") can increase the productivity of a backhoe by as much as 20%. In other words, by reducing unwanted oscillation of the backhoe arm and the inherent delay while the oscillation stops, a backhoe operator may increase the amount of material that can be moved by 20%. It would therefore be beneficial to provide this capability for currently existing backhoes. What is needed, therefore, is a method for retrofitting a backhoe, backhoe valve assembly or boom swing valve with a boom swing damping circuit. It is an object of this invention to provide such a method.

SUMMARY OF THE INVENTION

In accordance with the first embodiment of the invention, a method of retrofitting a boom swing control valve with a backhoe assembly swing damping circuit is provided includes the steps of disconnecting a pair of hydraulic lines from the output ports of the boom swing control valve, coupling the swing damping circuit to the boom swing control valve, and connecting a pair of hydraulic lines to the output ports of the swing damping circuit. The step of coupling may include the step of attaching the first valve body having the swing damping circuit to a second valve body having the boom swing control valve. The step of attaching may include the step of bolting the first valve body to the second valve body. The step of bolting may include the step of inserting a bolt through a portion of the first valve body and threading the bolt into the second valve body. The first valve body may define first and second ports configured to receive fluid from and transmit fluid to the second valve body. The second valve body may define third and fourth ports configured to receive fluid from and transmit fluid to the first valve body. The step of attaching may include the step of aligning the first port with the third port and aligning the second port with the fourth port. The step of attaching may include the step of abutting the first and third port and abutting the second and the fourth port. The step of attaching may include the step of fixing the first valve body to the second valve body after the steps of aligning and abutting.

In accordance with the second embodiment of the invention, a method for retrofitting a backhoe with a boom swing damping circuit is provided where the backhoe includes a vehicle, a backhoe assembly pivotally coupled to the vehicle, a swing cylinder coupled to the vehicle and to the backhoe assembly to pivot the backhoe assembly, an operator actuated boom swing control valve with a first port coupled via a hydraulic line to a port of the swing cylinder and a second port also coupled via a second hydraulic line to the swing cylinder, wherein the swing damping circuit includes a valve body defining a first fluid path that extends between the first inlet and outlet port in the valve body and a second path extending between a second and inlet and outlet port of the valve body and defining a third fluid path that fluidly couples the first and second paths and also includes a bypass valve in the third path to control fluid flow through the third path where the method includes the steps of disconnecting the first and second hydraulic lines from the first and second outlet ports of the boom swing control valve aligning the inlet ports of the valve body of the swing damping circuit with the outlet ports of the boom swing control valve and coupling the first and second inlet ports of the valve body of the swing damping circuit to the first and second outlet ports of the control valve. The inlet ports of the valve body the swing damping circuit may be formed in a first generally plainer surface of the swing damping circuit valve body. The first and second outlet ports of the control valve may be formed in a second generally plainer surface of the control valve body. The step of aligning may include the step of positioning the first and second surfaces into an abutting relationship.

In accordance with the third embodiment of the invention, a method for retrofitting a backhoe with a boom swing damping circuit is provided where the backhoe has a boom swing control valve that's fluidly coupled to at least one boom swing cylinder by first and second hydraulic lines and the method includes the steps of disconnecting the boom swing control valve from the boom swing cylinder, fluidly coupling the two hydraulic lines to a swing damping circuit with a bypass valve disposed in the swing damping circuit to conduct fluid between the first and second hydraulic lines and reconnecting the boom swing control valve to the boom swing cylinder. Swing damping circuit may include first and second flow restrictors, these flow restrictors may be disposed to restrict flow between the boom swing control valve and the boom swing cylinder after the step of reconnecting.

In accordance with a fourth embodiment of the invention, a method of retrofitting a backhoe valve assembly with a swing damping circuit is provided where the valve assembly has a boom swing valve section, a boom lift valve section, a dipper lift valve section, each fluidly coupled by two hydraulic lines to a corresponding hydraulic cylinder for swinging the boom, lifting the boom and lifting the dipper, where the method includes the steps of removing the boom swing valve section from the valve assembly and replacing the boom swing valve section in the valve assembly with a combination boom swing valve and swing damping circuit section where the combination valve section includes a valve spool responsive to operator actuation and configured to provide bi-directional flow to the boom swing cylinder through two hydraulic lines and the swing damping circuit that responds to deceleration of a backhoe assembly and includes a bypass valve configured to provide fluid flow path that couples the extend port to the retract port of the boom swing cylinder. Method may include the step of combining the boom swing valve section with a swing damping circuit to create the combination valve section. It may also include the step of disconnecting the boom swing valve section from corresponding first and second hydraulic lines. It may also include the step of fluidly coupling the combined valve section to extend and retract ports of the boom swing cylinder. The method may also include the step of fluidly coupling the first hydraulic line to first outlet port of the combined valve section and to the extend port of the boom swing cylinder and fluidly coupling another hydraulic line to a second outlet port of the combined valve section and to a retract port of the boom swing cylinder. The bypass valve may include a fluid pressure actuated spool where the combined valve section includes a unitary valve body housing both an operator actuated directional control valve spool and the fluid pressure actuated spool. The unitary valve body may be comprised of the first valve body housing the operator actuated directional valve spool and a second valve body fixed to the first valve body and housing the first pressure actuated spool. The first and second valve bodies may be removably coupled to form the unitary valve body. First and second valve bodies may be removably coupled by threaded fasteners.

BRIEF DESCRIPTION OF THE DRAWINGS

The present invention will become more fully understood from the following detailed description, taken in conjunction with the accompanying drawings, wherein like reference numerals refer to like parts, in which.

DETAILED DESCRIPTION OF THE PREFERRED EMBODIMENT

Figure 1:
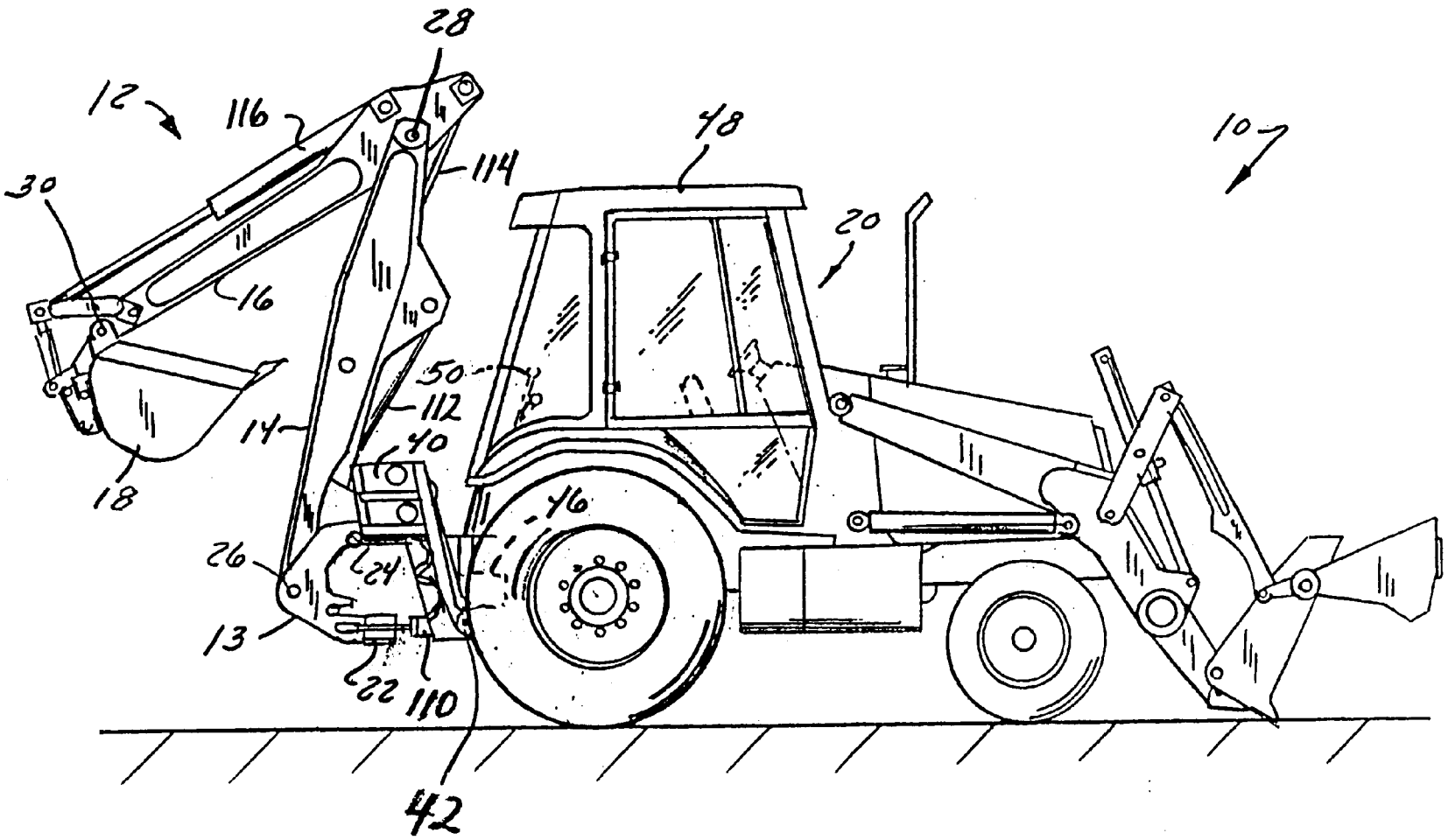
FIG. 1 is a side view of a backhoe showing the backhoe assembly pivotally attached to the backhoe vehicle and the location of the backhoe valve assembly.

FIG. 1 shows a typical backhoe 10 having a backhoe assembly 12 formed of a boom base 13, a boom 14, a dipper 16 and a bucket 18, and a tractor 20 to which the backhoe assembly is attached.

The boom base 13 is pivotally coupled to the tractor at its lower end and pivots about two pivot joints 22, 24 that define a vertical relative rotational axis of boom base rotation with respect to the vehicle itself. The boom base is constrained to rotate about this axis with respect to the vehicle.

The boom 14 is pivotally coupled to the boom base 13 at its lower end by a boom pivot joint 26. The boom pivot joint is typically formed by a pin that extends between and couples the boom to the boom base. The boom pivot joint defines a generally horizontal relative rotational axis of boom motion with respect to the boom base. The boom is constrained to rotate about this axis with respect to the vehicle.

The dipper 16 is pivotally coupled to the upper end of the boom 14 by a dipper pivot joint 28. The dipper pivot joint is typically formed by a pin that extends between and couples the dipper 16 to the boom 14. The dipper pivot joint defines a generally horizontal relative rotational axis about which the dipper pivots with respect to the boor.

The bucket 18 is pivotally coupled to the far end of the dipper 16 by a bucket pivot joint 30. Joint 30 is typically formed by a pin that extends between and couples the bucket and the dipper. The bucket joint constrains the bucket to pivot with respect to the dipper about a generally horizontal relative rotational axis.

In addition to these basic linkages, the backhoe assembly includes several hydraulic actuators, typically dual acting, dual ported bidirectional hydraulic cylinders, that cause the various linkages described above to move with respect to one another.

For example, there is at least one (and preferably at least two) boom swing cylinders 110 that are coupled to and between the vehicle and the boom base to pivot the boom base relative to the vehicle. One end of each of the boom swing cylinders is attached to the vehicle 20 and the other end is attached to the boom base 13.

A boom lift cylinder 112 is coupled to and between the boom 14 and the boom base 13 to pivot the boom relative to the boom base. One end of cylinder 112 is attached to the boom and the other end of the cylinder 112 is attached to the boom base.

A dipper cylinder 114 is coupled to and between the dipper 16 and the boom 14 to pivot the dipper relative to the boom. One end of the cylinder 114 is attached to the dipper and the other end of the cylinder is attached to the boom.

A bucket cylinder 116 is coupled to and between the bucket 18 and the dipper 16 to pivot the bucket relative to the dipper. One end of the cylinder 116 is attached to the bucket and the other end of the cylinder is attached to the dipper.

In addition to the backhoe assembly, there are two stabilizers 40 that are pivotally coupled to the vehicle each about its own generally horizontal relative rotational axis. One of these stabilizers is shown in FIG. 1. The other is similarly located on the other side of the vehicle. The stabilizers extend outward from the vehicle and are of sufficient length that they engage the ground when they are lowered (i.e. when they pivot downward about their corresponding axes of rotation. The stabilizers are coupled to the vehicle by pivot joints 42 that constrain their relative rotation with respect to the vehicle in a generally horizontal plane. The pivot joints 42 are typically in the form of a pin that extends between and is coupled to both the stabilizer and the vehicle itself. Each stabilizer has an associated hydraulic actuator 118, 120 (FIG. 2B) that is coupled to and between that stabilizer and the vehicle to raise and lower the stabilizers by pivoting them about their respective rotational axes.

Each of the hydraulic actuators noted above are fluidly coupled to a corresponding section of valve assembly 46 that is located underneath the backhoe cabin 48 and is disposed vertically between the upper 24 and the lower 22 pivots.

Each section of the valve assembly 46 has a corresponding valve actuator (here shown as a lever 50) that extends upward from each valve section, through the floor of the backhoe cabin and into the cabin itself. The operator manually actuates each of the valve sections using the valve actuators to thereby send hydraulic fluid to and move each of the corresponding hydraulic actuators shown above. When the operator moves a lever 50, the lever moves a corresponding spool in a corresponding valve section, which in turn directs fluid through two hydraulic lines (not shown) that are coupled to two ports on the valve section at one end and to two ports (the extend and retract ports) of the hydraulic actuator on the other end. Each section of the valve and each hydraulic actuator to which it is attached has its own corresponding lever.

Figure 4:
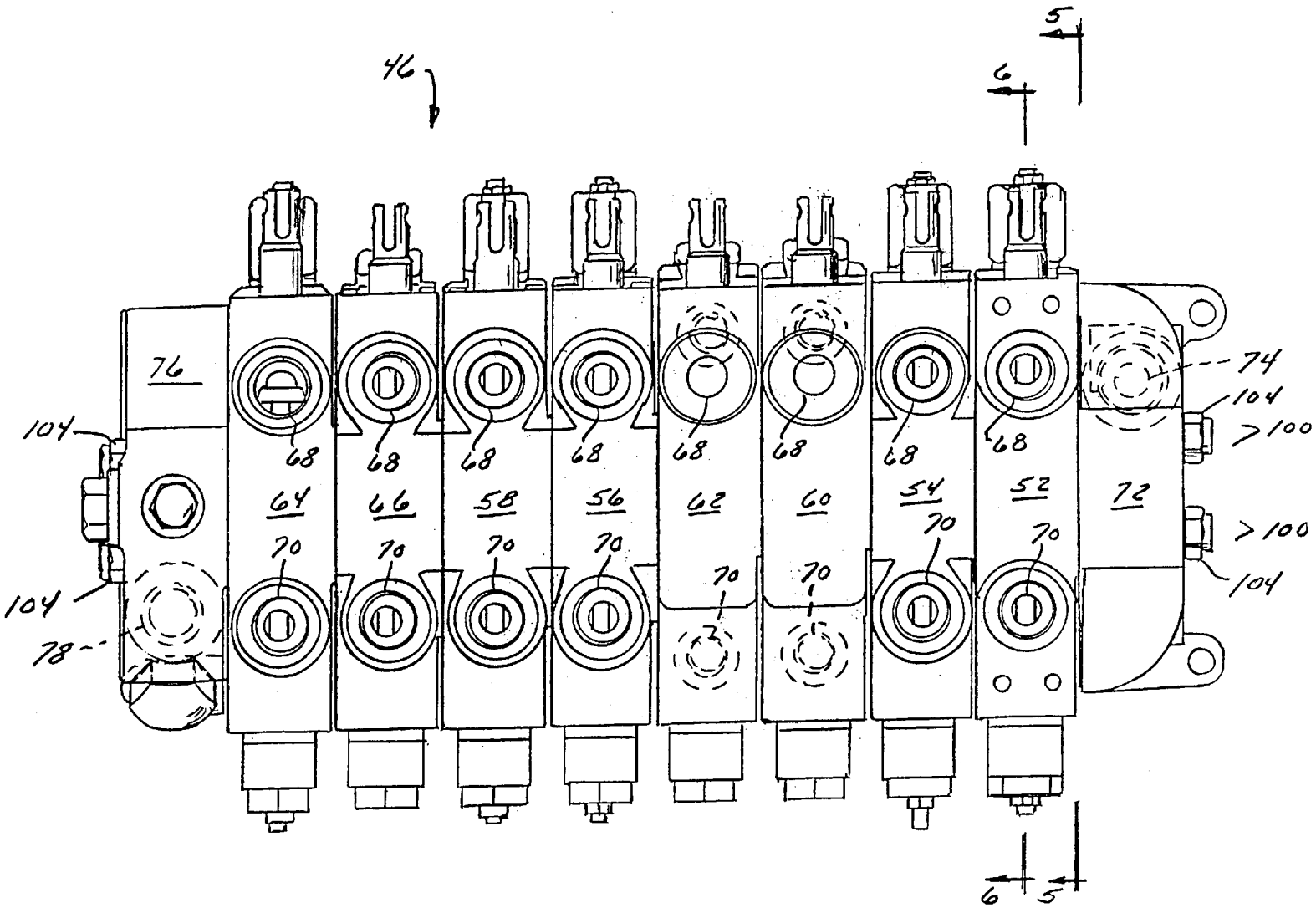
FIG. 4 is a top view of the pre-retrofit unitary valve assembly 46 that is shown in hydraulic schematic form in FIG. 2B.

FIG. 4 illustrates the valve assembly 46 in a top view as it would appear prior to being retrofitted with swing damping circuit 133. The valve assembly is a unitary assembly comprised of several valve sections including a boom swing section 52, a boom lift section 54, a dipper section 56, a bucket section 58, a left stabilizer section 60, a right stabilizer section 62 and an auxiliary valve section 64 as well as an optional valve section 66 configured to extend the dipper (for vehicles having an extending dipper feature).

Each valve section is fluidly coupled to its corresponding hydraulic actuator by a pair of hydraulic lines 124, 126 (FIG. 2B) that are attached to a pair of output ports 68, 70 on each valve sections.

These ports are located on top of each valve section preferably in a fore-and-aft relationship as shown in FIG. 4. The valve output ports provide bi-directional flow to and from the hydraulic actuator that is fluidly coupled to the output ports. The fluid flowing through the pair of hydraulic lines moves the hydraulic actuator to which they are attached.

The valve assembly has a high-pressure fluid end cap 72 fixed to one end of the valve assembly that is coupled to a hydraulic pump. The cap distributes the high-pressure hydraulic fluid to each of the valve sections. It receives hydraulic fluid from a hydraulic line 73 extending from the end cap to a hydraulic pump 106. This hydraulic line is coupled to an inlet port 74 on the end cap.

The valve assembly also has a low-pressure fluid end cap 76 fixed to the other end of the valve assembly 46 that gathers low pressure fluid exhausted from each valve section. The low-pressure end cap is coupled to a low-pressure hydraulic line 77 that extends from an outlet port 78 on the low-pressure end cap to a hydraulic tank 108 to return hydraulic fluid to the tank.

Figure 5:
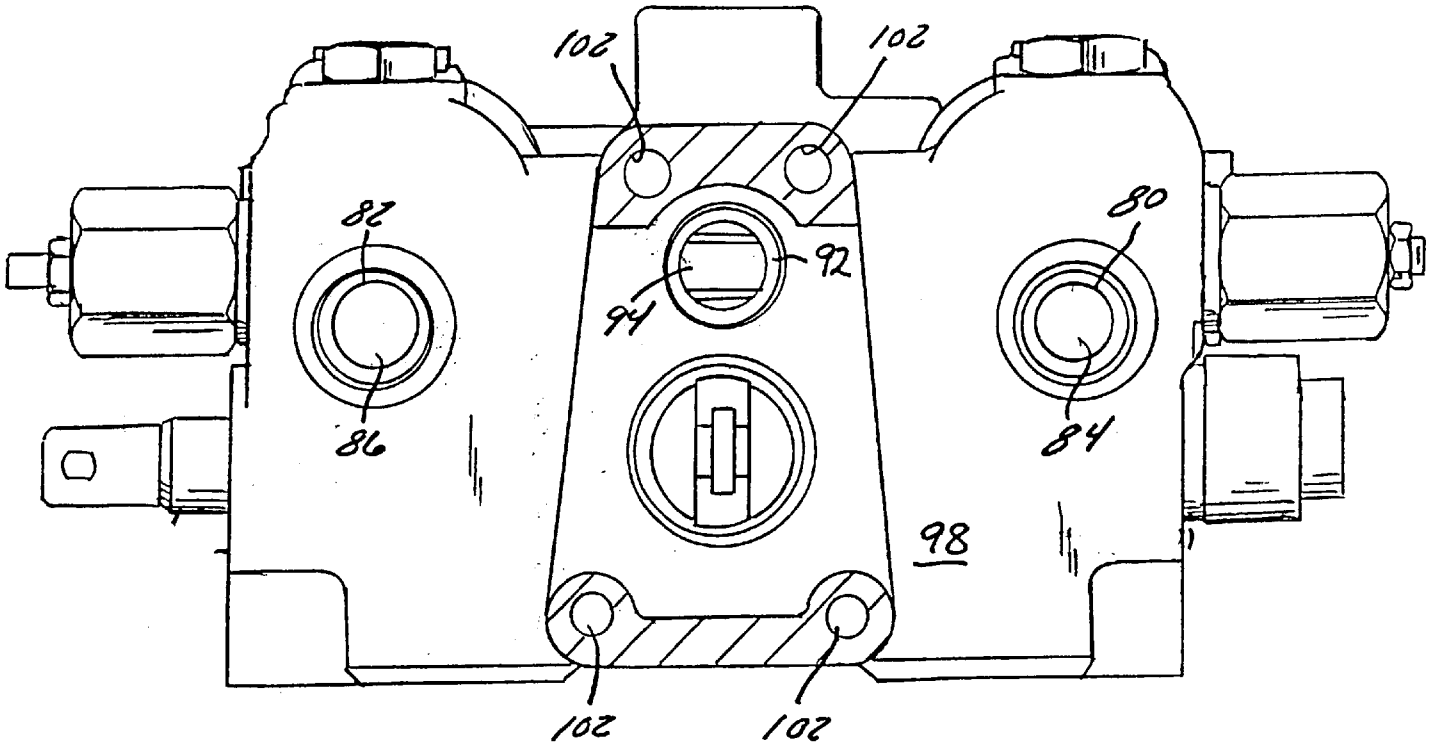
FIG. 5 is a side view of the boom swing valve section 52 of valve assembly 46 taken at Section 5—5 in FIG. 4, and showing a port and spool arrangement common to all of the valve sections in valve assembly 46 of FIG. 4.

Referring to FIG. 5, each of the valve sections has four return ports, two 80, 82 on each side that face, abut, and are aligned with similar return ports 80, 82 on the adjacent valve sections. The two return ports 80, 82 on one side of each valve section are fluidly coupled to the two identically located and oriented return ports on the other side of that section by two internal low-pressure fluid passageways 84, 86 inside that valve section. When the valve sections are assembled into a single valve assembly 46, these internal passageways 84, 86 and the two return ports 80, 82 on each side collectively define two common internal low-pressure fluid paths 88, 90 (FIG. 2B) that extend between, through and are defined by each of the valve sections.

These paths 88, 90 are configured to permit hydraulic fluid to flow between and through each valve section and back to end cap 76 thereby providing a common return path for low-pressure hydraulic fluid for each of the valve sections.

Each of the valve sections also has two supply ports 92, one on each side of the section that face, abut, and are aligned with similar supply ports on the adjacent valve sections. The supply port on one side of each valve section is fluidly coupled to the identically located and oriented supply port on the other side of that section by an internal high-pressure fluid passageway 94 inside that valve section. As a result, when the valve sections are assembled into a single valve assembly 46, these internal passageways and the return ports collectively define a common internal high-pressure fluid path 96 (FIG. 2B) that extends between, through and is defined by each of the valve sections.

This path 96 is configured to permit hydraulic fluid from the high-pressure end cap 72 to flow between and into each of the valve sections thereby providing a common supply of hydraulic fluid under pressure to each of the valve sections.

Each of the valve sections is in the form of a separately machined valve body 98. Referring back to FIG. 4, the valve assembly is held together as a single unit by four tie rods 100 that extend completely through all the valve sections and through the end caps 72, 76. Four holes 102 (FIG. 5) are provided in each valve section to receive and support these tie rods.

Nuts 104 are threaded onto the free ends of the tie rods extending out of the end caps. When tightened, the nuts and tie rods clamp the valve sections together as a single unitary valve assembly 46.

Figure 2A:
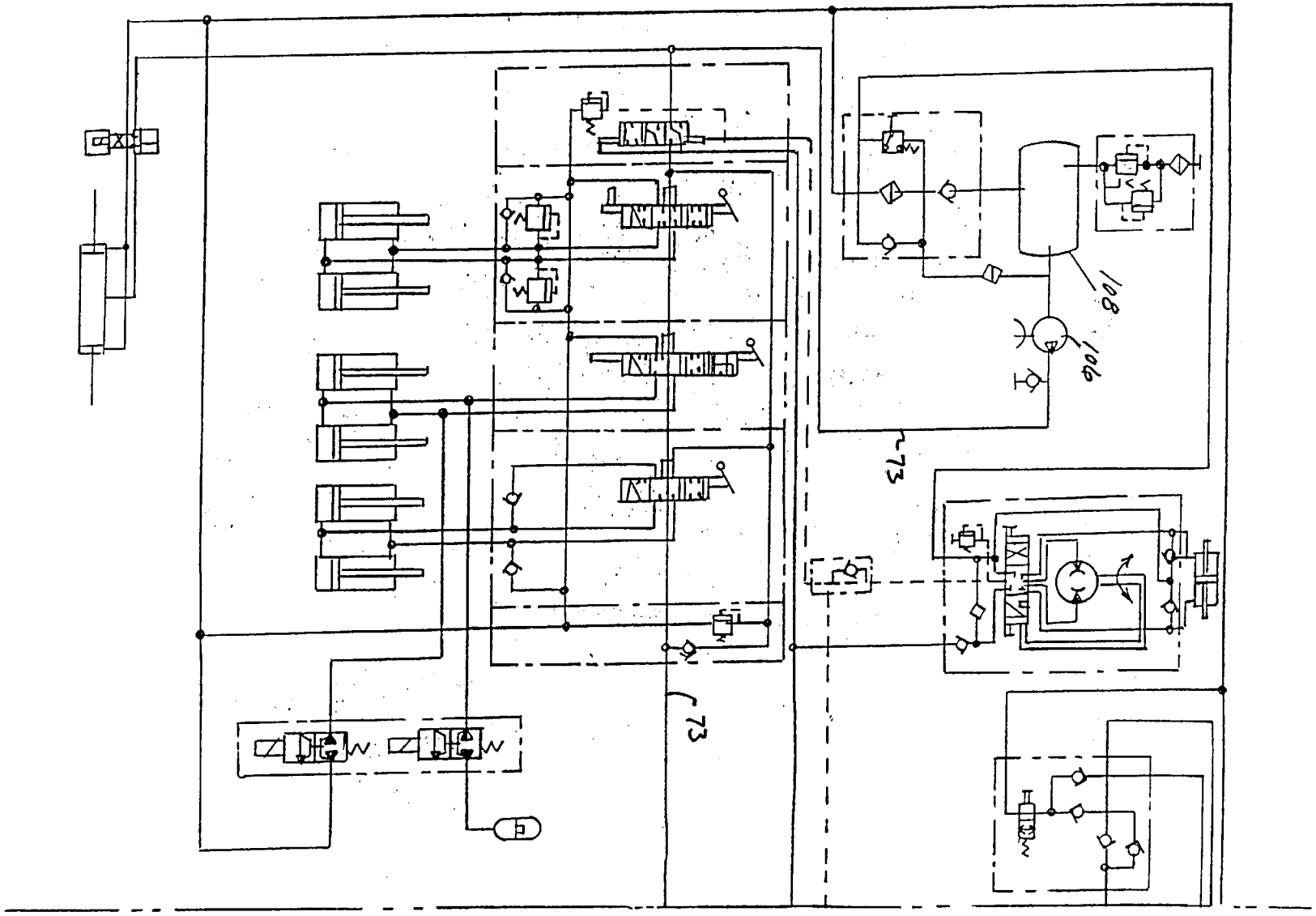
FIGS. 2A and 2B are a schematic diagram of the backhoe hydraulic system showing the swing damping circuit 133 to be retrofitted into the circuit according to the present invention.
Figure 2B:
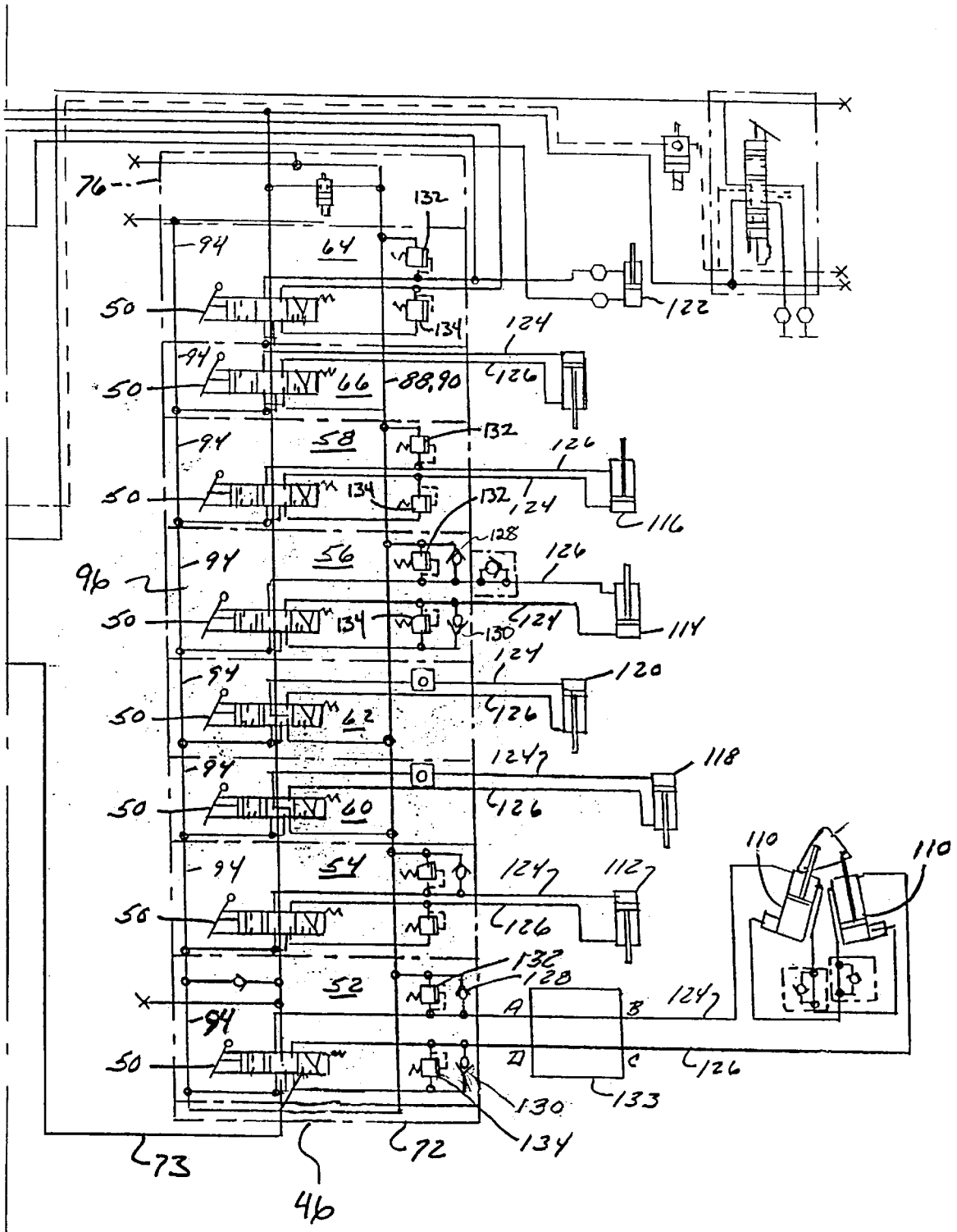

FIGS. 2A and 2B are a hydraulic schematic of the backhoe showing the hydraulic pump 106, the hydraulic tank 108, the valve assembly 46, the individual valve sections 52–66, the hydraulic actuators controlled by each valve section, and the hydraulic lines 124, 126 coupling these items.

The valve assembly 46 is indicated by a large dashed box. This dashed box is subdivided into several smaller dashed boxes, each smaller box indicating a single valve section. Dashed boxes on each end of the valve assembly indicate the end caps 72, 76 that couple the tank and pump to the valve assembly.

The common internal high-pressure fluid path 94 is shown in FIG. 2B as a single line or hydraulic path that extends through each of the smaller dashed boxes (i.e. each of the valve sections). The supply ports on each valve are shown logically at the points where the path 94 passes from one smaller dashed box (i.e. valve section) to an adjacent smaller dashed box (i.e. valve section).

The common internal low-pressure fluid paths are similarly shown in FIG. 2B. They are schematically represented as a single hydraulic line identified as items 88, 90 that extends through each of the smaller valve sections. The return ports on each valve section and their alignment are shown as the points where the low-pressure fluid paths 88, 90 pass from one valve section to an adjacent valve section.

There are eight valve sections in the valve assembly (FIGS. 2B and 4). They are generally called the boom swing section, the boom lift section, the dipper section, the bucket section, the left and right stabilizer sections, the "extend-a-hoe" section and the auxiliary section.

Each of these sections controls the flow of fluid to and from the hydraulic actuator to which it is fluidly coupled: the boom swing cylinders 110, the boom lift cylinder 112, the dipper cylinder 114, the bucket cylinder 116 and the two stabilizer cylinders 118, 120 and an auxiliary hydraulic actuator 122 (such as a pavement breaker or a post hole digger) are shown in schematic form in FIG. 2B as dual-ported double-acting cylinders. They are shown in FIG. 2B as connected to their corresponding valve section by two hydraulic lines; one line 124 coupled to the extend port and another line 126 coupled to the retract port. The boom swing cylinders 110 are cross-coupled so one, cylinder retracts as the other extends.

Each valve section includes a bi-directional control valve. As the spool valve symbol shown inside each of the valve sections (FIG. 2B) shows, the bi-directional control valves provide flow in both directions through the cylinders to which each is coupled by hydraulic lines 124, 126. In one position they send fluid through one line (124 or 126) and receive fluid back through the other line (126 or 124). The effect is to controllably move the hydraulic cylinders in one direction that extends them, and also in another direction to retract them.

The valve in each valve section 52–66 has a first valve position in which fluid flows from the pump 106, through the common high pressure path 96, through the valve in that valve section, out to the associated cylinder extend port through line 124 (causing the cylinder to extend) and back from the cylinder retract port through line 126, through the valve section 52–66, into the common low pressure path 88, 90, and thence back to the tank.

The valve in each valve section 52–66 has a second valve position in which fluid flows from the pump 106, through the common high pressure path 96, into the valve and out through line 126 to the cylinder retract port, and communicates fluid back from the extend port of the cylinder through line 124 through the valve to the common internal low-pressure fluid path and thence back to the tank thereby causing the cylinder to retract.

In a third position the valve in each valve section blocks the flow of fluid both to and from the retract and extend ports of its associated cylinder thereby holding its associated cylinder in a fixed position.

Several of the valve sections, including the boom swing valve section 52, also include anti-cavitation valves 128, 130 that prevent the formation of a vacuum in their corresponding hydraulic actuators. Each of these anti-cavitation valves 128, 130 fluidly couples a port of its associated hydraulic actuator with the hydraulic tank via the common internal low-pressure path. Each anti-cavitation valve 128, 130 is fluidly coupled to and disposed between an output port (68 or 70) of the directional control valve in that valve section and the common internal low pressure paths 88, 90, to permit fluid in the low pressure paths 88, 90 to flow through the anti-cavitation valve and back into the cylinder, by-passing the spool valve, whenever the pressure in the hydraulic line (and hence at the associated cylinder port) drops to near Ø psi.

Several of the valve sections, including the boom swing section 52 also include pressure relief valves 132, 134 connected between the hydraulic lines 124, 126 that join the valve sections and their cylinders, and the common internal low pressure path, 88, 90, respectively, at the other end.

When the pressure in either of lines 124 or 126 rises above a safe operating pressure, the pressure relief valve on that line opens and permits fluid to flow back to the tank via the common internal low-pressure fluid paths 88, 90. In this manner, if the spool valve is closed suddenly, thereby generating a sudden surge of pressure in the associated cylinder, it can be dissipated to the extent it exceeds the safe operating pressure of the hydraulic system.

Once the pressure has dropped below the safe operating pressure, however (typically about 2500 to 3000 psig), the pressure relief valve 132, 134 closes, thereby maintaining the pressure at a level just below the safe operating pressure of the system.

FIG. 2B shows a swing oscillation damping circuit 133 (the "swing damping circuit") that fluidly couples the two hydraulic lines 124, 126 that carry fluid back and forth between the boom swing valve section 52 and the boom swing cylinders 110. This invention is directed to a method for retrofitting this circuit to boom swing valve section 52 to provide swing-damping capability to a boom swing valve. The circuit is shown in greater detail in FIG. 3.

Swing damping circuit 133 provides flow between the two hydraulic lines 124, 126 to damp incipient oscillations of the backhoe assembly and in particular oscillations of the boom dipper and bucket with respect to the boom base about the vertical axis defined by pivot joints 22 and 24. This circuit has a valve 305 that opens and closes in response to deceleration of the backhoe assembly, as indicated by the pressure and direction of fluid flow through the two hydraulic lines 124, 126.

Figure 3:
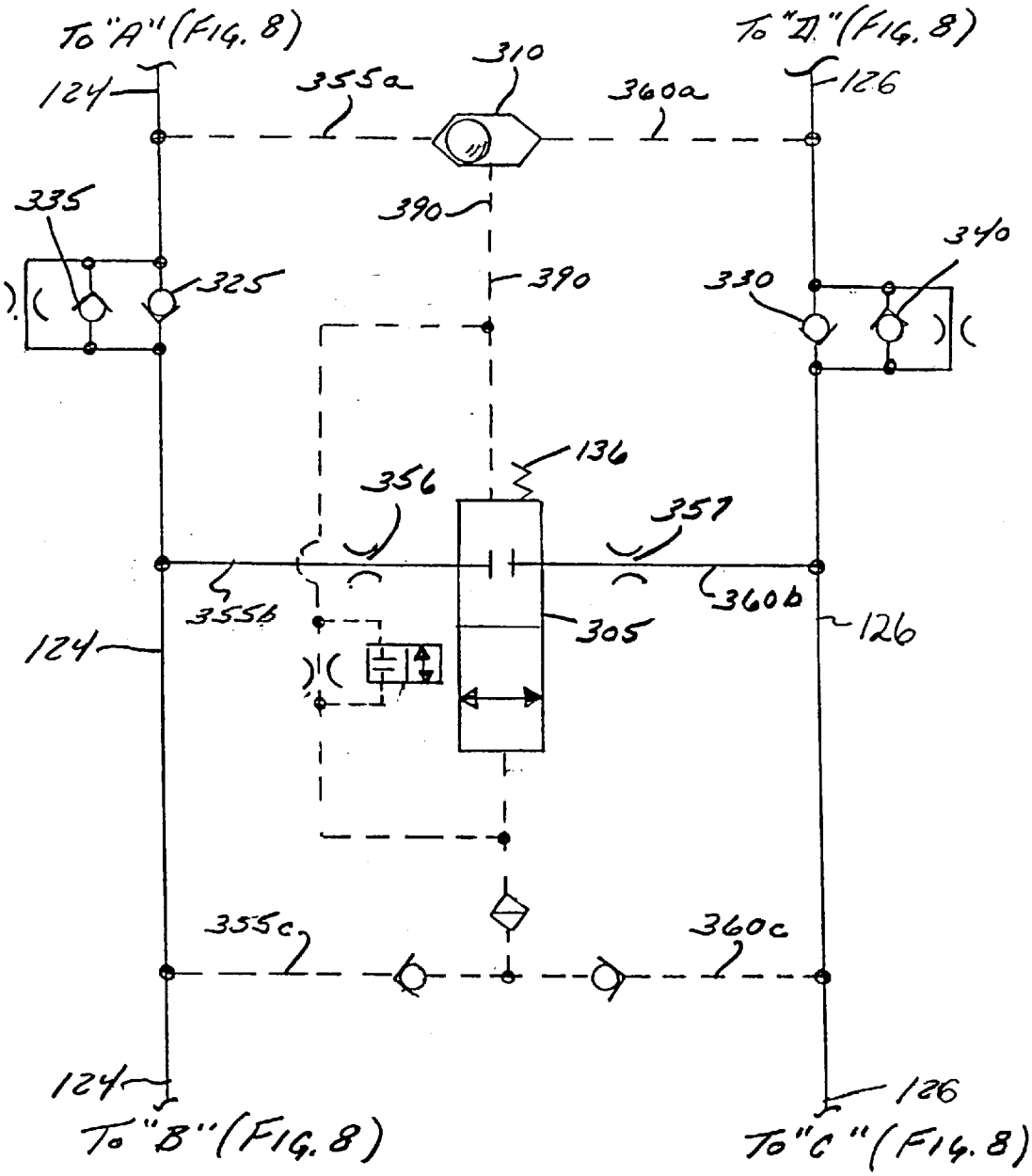
FIG. 3 is a hydraulic schematic diagram of the swing damping circuit that is to be retrofitted according to the present invention as shown in FIG. 2.

Referring to FIG. 3, which shows circuit 133 in greater detail, bypass (or crossover) valve 305 couples the two hydraulic lines 124, 126 through hydraulic lines 355*b*, 360*b*, permitting hydraulic fluid to flow between the two in either direction when circuit 133 senses boom deceleration.

Valve 305 opens whenever pressure on its lower end (the word "lower" "upper," "left" and "right" refer to the orientation shown in FIG. 3 and not to any specific orientation as installed) is more than 40 psi greater than the pressure applied on its upper end as provided by spring 136. The upper end of valve 305 is coupled through hydraulic signal line 390 to hydraulic signal lines 355*a*, 360*a* that are in turn coupled to an upper portion of the two hydraulic lines 124, 126. The lower end of valve 305 is similarly coupled to two hydraulic signal lines 355*c*, 360*c* that are connected to a lower portion of two hydraulic lines 124, 126. Valve 305 opens and closes when fluid passing through these signal lines acts against the top and bottom of valve 305.

A pressure differential is created across the upper and lower portions of the two hydraulic lines 124, 126 by spring loaded check valves 325, 330, 335, 340 to create that pressure differential whenever fluid is forced through the hydraulic lines 124, 126.

For pressurized fluid flows going from the boom swing valve 52 to the boom swing cylinders 110, check valves 335 and 340 create a pressure drop that tends to close valve 305 by applying a greater fluid pressure on its upper end than its lower end. For pressurized fluid flows going from the boom swing cylinders 110 to the boom swing valve 52 check valves 325 and 330 create a pressure drop that tends to open valve 305 by applying a greater fluid pressure on the lower end than on the upper end. When this pressure difference across the check valves applies pressure on the lower end of valve 305 that is 40 psi greater than the pressure applied to the upper end, it is sufficient to overcome the spring force applied to valve 305, and valve 305 opens. The spring force, as well as the specific size of the restrictions 356, 357 in the crossover passageway defined by items 355*b*, 360*b*, will vary depending upon the specific application.

The operator accelerates the backhoe assembly by operating boom swing valve 52 to send pressurized fluid from the pump 106 to one or the other of the two outlet ports 68, 70 on the boom swing cylinders. Inherently, the pressure of the fluid going to cylinders 110 is greater than the pressure of the fluid coming from the cylinders during acceleration of the boom and therefore valve 305 remains closed with a pressure on the upper end of valve 305 greater than the pressure on the lower end of valve 305.

Once the backhoe assembly has been accelerated to the desired speed, the operator begins closing the boom swing valve 52 cutting off fluid flow both to and from the boom swing cylinders 110. This tends to cause the backhoe assembly 12 to stop moving. Due to its inertia and momentum, the backhoe assembly 12 attempts to continue moving in the same direction at the same speed. The backhoe assembly, which is mechanically coupled to the pistons of the boom swing cylinders 110, applies a force to the pistons that is equal and opposite to the stopping force applied by the pistons to the backhoe assembly 12. The backhoe-generated inertial force increases the pressure in the boom swing cylinders and forces fluid out of those cylinders and up through line 126. This forced-out fluid passes through the check valve 330 in an upward direction causing a 100 psi pressure drop in hydraulic line 126. With a 100 psi higher pressure in the lower portion of hydraulic line 126 than in the upper portion, a net upward pressure difference of 100 psi is applied to the bottom of valve 305. This is sufficient to overcome the 40 psi downward pressure applied by spring 136 and valve 305 opens.

Once valve 305 is opened, fluid in hydraulic line 126 is permitted to flow through the crossover or by-pass passageway defined by lines 355*b*, 360*b* and valve 305 to the other hydraulic line 124. By permitting the fluid to flow from a region of high pressure (line 126) to a region of lower pressure (line 124) through a flow-restricted passageway, excessively low pressure in the boom swing cylinder attached to hydraulic line 124 is avoided, and pressure between hydraulic lines 124 and 126 equalizes after the backhoe assembly 12 stops and the incipient oscillation of the backhoe assembly is damped.

While the operational description above describes the case of fluid entering the boom swing cylinder through line 124 and exiting the cylinder through line 126, the function of swing damping circuit 133 is identical when the flows are reversed (i.e. when valve 52 sends fluid through lines 124 and 126 in the opposite direction) since circuit 133 is symmetric with respect to lines 124 and 126 and valve 52 is bi-directional.

The swing-damping circuit of FIG. 3, therefore, permits the flow of hydraulic fluid from one line extending between the boom swing control valve and the boom swing cylinders to the other line. It is bidirectional, allowing flow both ways, the flow direction depending upon which hydraulic line 124, 126 receives fluid ejected from the boom swing cylinder when the boom swing valve is closed. This, in turn, depends upon the direction the backhoe assembly is swinging when the operator closes valve 52. Further details of the operation of circuit 133 are disclosed in co-pending U.S. patent application Ser. No. 09/661,348, entitled "Hydraulic System And Method For Regulating Pressure Equalization To Suppress Oscillation In Heavy Equipment", which is assigned to Case Corporation.

Figure 6:
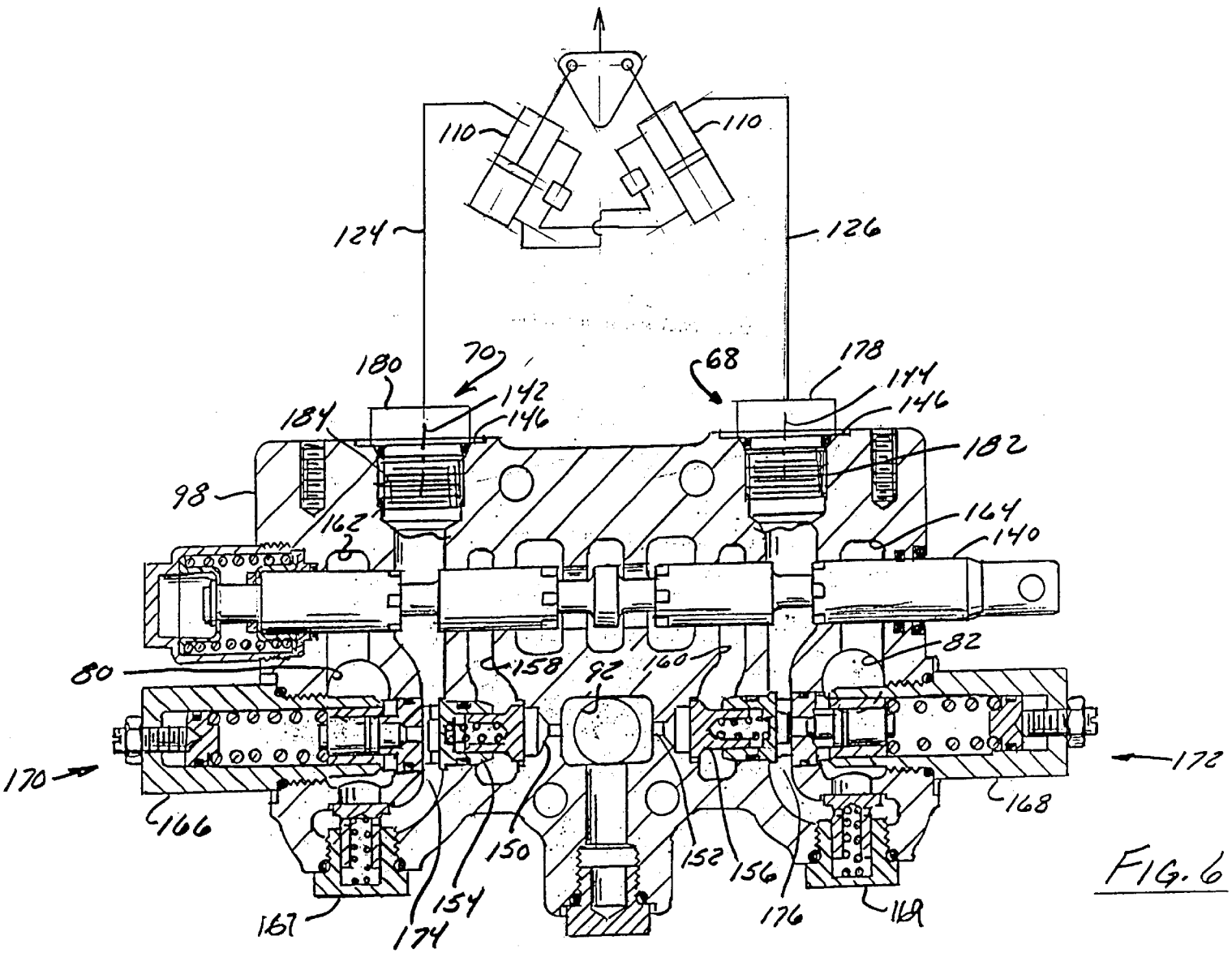
FIG. 6 is a cross-sectional view of the boom swing valve section 52 of valve assembly 46 taken at Section 6—6 in FIG. 4 and showing a spool configuration and orientation and the port configuration and orientation common to all of the valve sections of valve assembly 46.

FIG. 6 is a cross-section of the boom swing valve section 52 and shows valve 52 as it would appear when coupled to boom swing cylinders 110 before being retrofitted with swing damping circuit 133. It is typical of the other valve sections in the valve assembly in the location and orientation of the valve spool, the configuration of the valve spool, the passageways feeding the valve spool, the ports that form the common internal high pressure and low pressure passageways that extend through the each of the valve spools and the valve assembly as a whole, and in the location and construction of the over-pressure relief and cavitation valves.

Valve section 52 is in the form of a generally rectangular valve body 98 that defines internal flow passages and supports a spool 140 that is slidably mounted in the valve body 98 to direct fluid to and from the hydraulic actuator or cylinder to which valve section 52 is coupled—in this case boom swing cylinders 110.

Valve section 52 has a pair of bidirectional outlet ports 68, 70 that send fluid to and from the boom swing cylinders. These ports are disposed in a parallel relationship with parallel longitudinal axes 142, 144 and are in the same planar surface. Each output port has a sealing surface 146 perpendicular to the longitudinal axis of the port. These two sealing surfaces 146 preferably define parallel planes. More preferably they are coplanar.

Disposed on either side of the valve body 98 are the ports 80, 82 that define the common internal low-pressure fluid path that extends through the valve body. Two of these ports 80, 82 are shown in FIG. 6 as partially dashed circles. The other ports 80, 82 are in the identical positions as the illustrated ports, but are located on the portion of the valve section removed in the FIG. 6 cross-sectional view. These ports can be seen in FIG. 5, which is a side view of the boom swing damping valve 52.

Disposed on either side of valve body 98 are ports 92 that define the common internal high-pressure high-pressure hydraulic fluid path 96 that extends through each valve body 98. One of these ports is shown in FIG. 6. The other port is on the identical position as the illustrated port, but is located on the portion of the valve section removed in the FIG. 6 cross-sectional view. Removed port 92 can be seen in FIG. 5, a side view of valve 52.

Fluid enters valve body 98 through ports 92 and is alternately conducted through internal passageways 150 and 152, through check valves 154 and 156, respectively, and into cavities 158 and 160 surrounding the spool. When the spool is shifted to the left (in FIG. 6), hydraulic fluid from the common high-pressure path 92 passes through passageways 152 and 160 to output port 68. When the spool is shifted to the right (FIG. 6), fluid passes through passageways 150 and 158 to output port 70.

Fluid returns from the boom swing cylinders through either port 68 or 70, depending on the position of the spool. If the spool is shifted to the left (FIG. 6), then fluid returning through port 70 is conducted through passageway 162 to the tank return port 80. If the spool is shifted to the right (FIG. 6), then fluid returning through port 68 is conducted through passageway 164 to tank return port 82.

Overpressure relief valve cartridges 166 and 168 are threadedly engaged in bores 170 and 172, respectively, and are in fluid communication with outlet ports 70 and 68, respectively, to relieve hydraulic pressure greater than about 2700 psi in those ports by opening and returning fluid to tank ports 80 and 82, respectively, through fluid passageways 174 and 176 respectively. Anti-cavitation valves 128 and 130 here shown as anti-cavitation valve cartridges 167 and 169 permit fluid to flow in the opposite direction from tank ports 80 and 82 to outlet ports 70 and 68, respectively, whenever the pressure in the outlet ports falls to about 0 psi. Cartridges 166 and 167 therefore comprise valves 132 and 128, respectively, and cartridges 168 and 169 comprises valves 130 and 134, respectively.

Hydraulic lines 124, 126 extend from valve body 98 to the boom swing cylinders 110 and are coupled to the two output ports 68, 70 of valve 52 by threaded couplings 178, 180. These couplings have external threads that are threaded into corresponding female threads 182, 184 inside each of the output ports 68, 70. The couplings are typically swaged onto the end of hydraulic lines 124 and 126.

Figure 7:
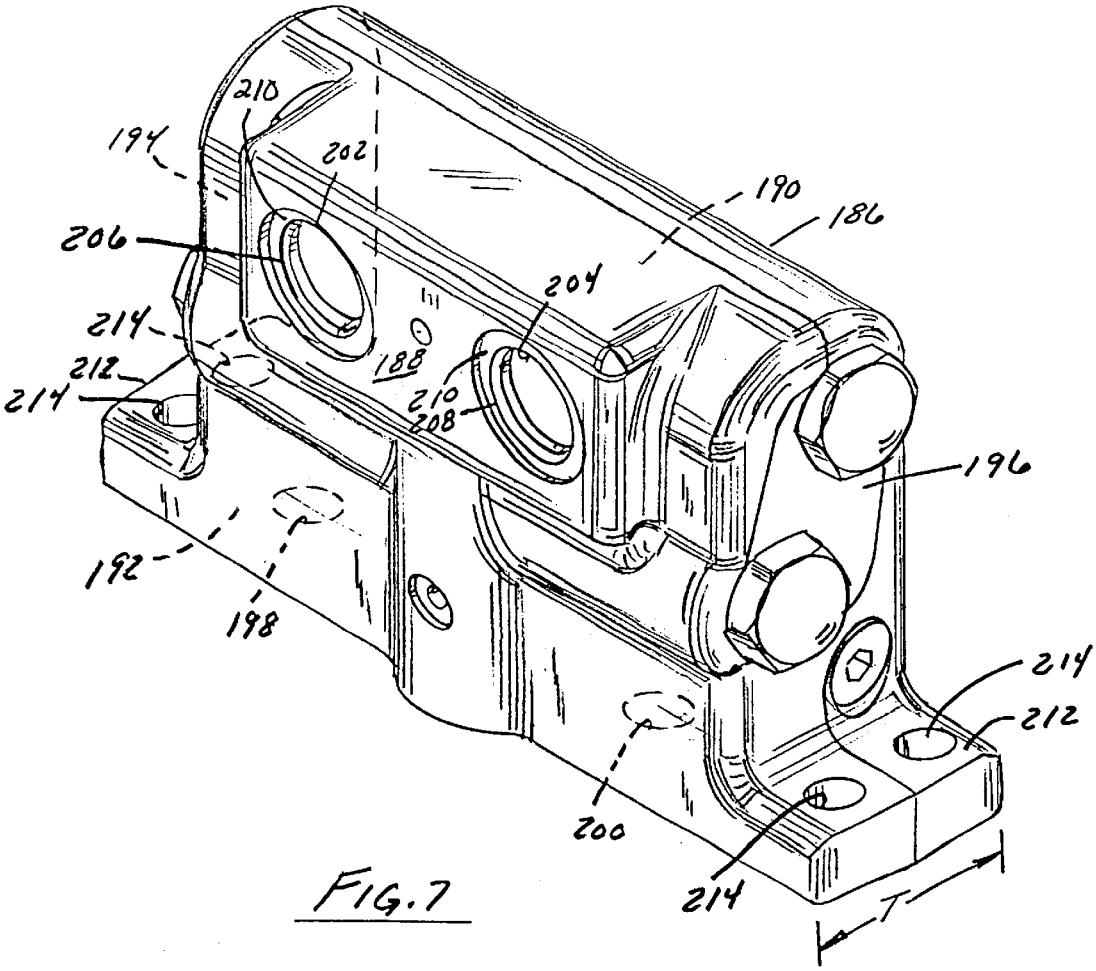
FIG. 7 is a perspective view of a valve body 186, in which the swing damping circuit 133 of FIGS. 2B and 3 is incorporated.
Figure 8:
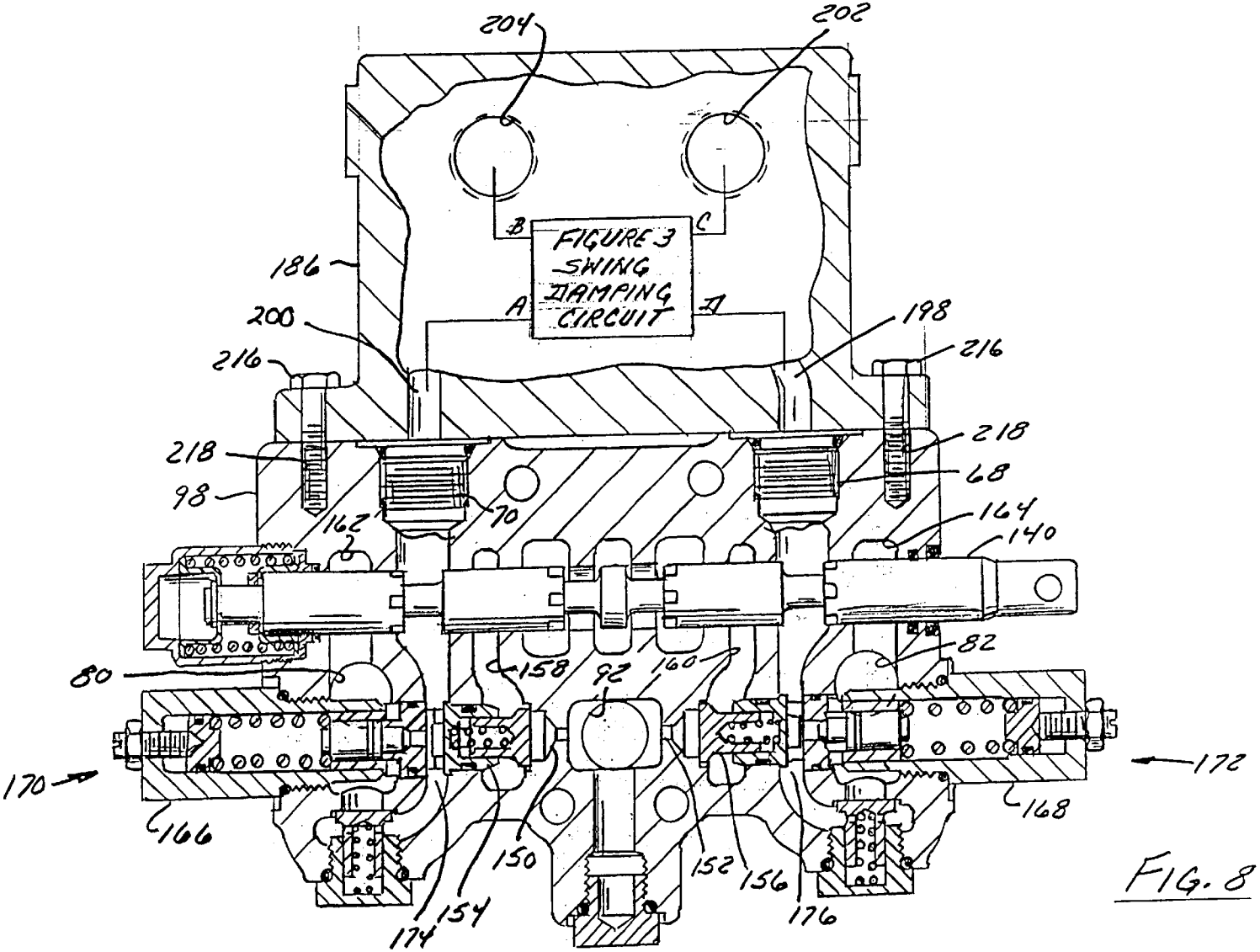
FIG. 8 illustrates a unitary valve body formed by retrofitting the boom swing control valve 52 of FIG. 6 with the swing damping circuit valve body 186 of FIG. 7, wherein the boom swing valve is shown in the same cross-sectional view as in FIG. 6 and the swing damping circuit is shown in Section 8—8 in FIG. 7, and further wherein the internal components of the swing damping circuit valve body 186 of FIG. 7 are shown in schematic form with reference to the schematic representation of swing damping circuit 133 in FIG. 3.

Referring now to FIGS. 7 and 8, swing damping circuit 133 of FIG. 3 is preferably embodied in a single valve body 186. Swing damping circuit valve body 186 has generally the same form as the boom swing valve body. It is generally rectangular, have a front planar surface 188, a back planar surface 190, a bottom planar surface 192, a first end surface 194, and a second end surface 196. The smallest overall dimension of the valve body is its thickness "T", which is generally the same as the thickness of valve body 98 of boom swing valve 52 to which it is retrofitted.

The lower planar surface 192 of the valve body has two valve ports 198, 200 configured to be coupled to the two output ports 68, 70 of the boom swing valve. Bottom surface 192 includes generally flat, machined coupling surfaces that are perpendicular to the longitudinal axis of ports 68, 70 and surround ports 68, 70.

Front planar surface 188 has two cylinder ports 202, 204 configured to be coupled to two hydraulic lines extending to the retract and extend ports of boom swing cylinders 110. These ports are equipped with female threads 206, 208 into which a male-threaded coupling fixed to the ends of two hydraulic lines going to the boom swing cylinders can be attached. The opening of each of the cylinder ports 202, 204 is surrounded by a generally circular and flat machined coupling surface 210 that is perpendicular to the longitudinal axis of its associated cylinder port. These surfaces are generally parallel to the back surface 190 of the valve body.

Flanges 212 extend from each end of the valve body 186 and have a lower surface that is generally coplanar with the bottom surface of the valve body. The flanges have the same thickness as the valve body and extend in opposite directions away from the valve body. Each of these flanges has two through holes 214 that are configured to receive threaded fasteners such as mounting bolts 216. The bolts, in turn, are configured to engage female-threaded holes 218 in the boom swing valve. In this manner valve body 186 of the swing damping circuit and valve body 98 of the boom swing valve section can be fixed together to form a single unitary valve body incorporating both a boom swing valve and a swing damping circuit.

Retrofitting valve assembly 46 of FIGS. 2B and 4 with swing damping circuit 133 of FIGS. 2B and 3 can be performed in several ways. In perhaps the easiest way, the two couplings 178, 180 that connect hydraulic lines 126 and 124 to valve section 52 can be unthreaded from each of ports 68 and 70 in boom swing valve section 52. This will disconnect both hydraulic lines 124 and 126 from valve section 52. In addition, the removal of couplings 178 and 180 exposes sealing surfaces 146 on the top of valve section 52 for sealing against ports 198 and 200 of swing damping circuit 133.

Once the couplings 178 and 180 are removed, swing damping circuit valve body 186 is positioned such that the two fluid ports 198 and 200 are aligned generally coaxially with ports 68 and 70. Once they are so aligned, as shown in FIG. 8, threaded fasteners 216 can be inserted through holes 214 in valve body 186 and threadedly engaged with mating threaded holes 218 in boom swing valve section 52. When these threaded fasteners are tightened, they compress port 198 against port 68 and port 200 against port 70 to provide a leak-proof seal, thus permitting fluid to be conducted directly from port 68 into port 198 and thence to fluid node "D" of the swing damping circuit shown in FIG. 3. In a similar fashion, fluid is also permitted to pass from port 70 into port 200 and thence to fluid node "A" of the swing damping circuit shown in FIG. 3. Ports 198 and 200 are preferably spaced the same distance apart that ports 68 and 70 are spaced.

As mentioned above, the swing damping circuit of FIG. 3 is formed in swing damping circuit valve body 186. A co-pending patent application entitled "Hydraulic System for Suppressing Oscillation in Heavy Equipment" (Attorney Docket No. 1426.032) shares common inventors with the present application and discloses one exemplary structural embodiment of swing damping circuit 133 of FIG. 3 as it could be formed within valve body 186.

Once swing damping circuit valve body 186 is fixed to boom swing valve 52, they collectively form a unitary valve body, albeit one that can be separated into two individual valve bodies. While the combined boom swing valve and swing damping circuit described above can be formed of two individual valve bodies bolted together, it should be clear that the same combination could be made by casting and machining a single piece of steel.

Once the swing damping circuit 133 has been attached to boom swing valve 52, two hydraulic lines can be threadedly attached to ports 202 and 204 of the swing damping circuit valve body 186 at one end, and at the other end attached to the two ports of boom swing cylinders 110. This is illustrated in FIG. 2B, which shows hydraulic lines 124 and 126 extending from the swing damping circuit 133 to two ports of boom swing cylinders 110. This is preferably done by reattaching the two hydraulic lines 124, 126 (that were earlier removed from valve body 98) to ports 204 and 202. Alternatively, replacement hydraulic lines can be attached to ports 204 and 202 and the boom swing cylinders in place of existing hydraulic lines 124 and 126.

It will not always be possible or convenient to take an existing valve assembly 46 and merely attach a swing damping circuit to the boom swing valve section 52 in that assembly. For example, it may be more convenient to manufacture and assemble a boom swing valve section 52 and swing damping circuit 133 in a single unitary valve body. In this case, valve assembly 46 could be retrofitted by removing an existing boom swing valve section 52 from a valve assembly 46 and replacing that boom swing valve section 52 with a combined boom swing valve section 52 and swing damping circuit 133 that form a single unitary valve body prior to installation as a part of valve assembly 46.

To perform this process of retrofitting a valve assembly with a swing damping circuit, the technician would first disconnect hydraulic lines 124 and 126 that couple boom swing valve section 52 from the boom swing cylinders 110. Next, the technician would loosen and remove nuts 104 from tie rods 100, thereby permitting the tie rods to be removed from valve assembly 46. Once the technician has removed the tie rods from valve assembly 46, he would then take the existing boom swing valve section 52 out of valve assembly 46. With the existing boom swing valve section 52 removed, the technician could then insert a combined unitary boom swing valve and swing damping circuit, (such as that shown in FIG. 8).

This combined boom swing valve and swing damping circuit could be formed in a single valve body, or in two or more valve bodies, fixed together, either removably or permanently. With the combined boom swing valve and swing damping circuit in place, the technician could then insert tie rods 100 through holes 102 in the valve sections (including holes 102 in the combined boom swing valve and swing damping circuit valve body). With the tie rods inserted, the technician could then thread nuts 104 onto the tie rods and tighten them, thereby fixing the individual backhoe valve sections together and reforming valve assembly 46.

In this second process of retrofitting the valve assembly with a swing damping circuit, the common internal high pressure fluid path and common internal low pressure fluid path collectively formed by each of the valve sections is disassembled when valve assembly 46 is disassembled. When tie rods 100 are loosened, and when the boom swing valve section 52 is removed, as described above, these two common internal paths are inherently disassembled or broken. They are also inherently reassembled and recreated when the combined boom swing valve and swing damping circuit are inserted into the disassembled valve assembly 46 and the tie rods are again inserted and tightened.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended Claims.

What is claimed is:

1. A method of retrofitting a boom swing control valve with a backhoe assembly swing damping circuit comprising the steps of:

disconnecting a first pair of hydraulic lines from a pair of output ports of the boom swing control valve;

coupling the swing damping circuit to the boom swing control valve in place of the first pair of hydraulic lines, including the step of attaching a first valve body comprising a swing damping circuit to a second valve body comprising the boom swing control valve; and connecting a second pair of hydraulic lines to a pair of output ports of the swing damping circuit.

2. The method of claim 1, wherein the step of attaching includes the step of bolting the first valve body to the second valve body.

3. The method of claim 2, wherein the step of bolting includes the step of inserting a bolt through a portion of the first valve body and threading the bolt into the second valve body.

4. The method of claim 1, wherein the first valve body defines first and second ports configured to receive fluid from and transmit fluid to the second valve body and further wherein the second valve body defines third and fourth ports configured to receive fluid from and transmit fluid to the first valve body.

5. The method of claim 4, wherein the step of attaching includes the step of aligning the first port with the third port and aligning the second port with the fourth port.

6. The method of claim 5, wherein the step of attaching includes the step of abutting the first and the third port and abutting the second and the fourth port.

7. The method of claim 6, wherein the step of attaching includes the step of fixing the first valve body to the second valve body after the steps of aligning and abutting.

8. The method of claim 1 wherein the first pair and the second pair are the same pair.

9. The method of claim 1 wherein the first pair and the second pair are different pairs.

10. A method for retrofitting a backhoe with a boom swing damping circuit, the backhoe comprising a vehicle, a backhoe assembly pivotally coupled to the vehicle, a dual ported boom swing cylinder coupled to the vehicle and to the backhoe assembly to pivot the backhoe assembly with respect to the vehicle, an operator actuated boom swing control valve having a first outlet port fluidly coupled via a first hydraulic line to a first port of the boom swing cylinder and a second outlet port fluidly coupled via a second hydraulic line to a second port of the boom swing cylinder, and further wherein the swing damping circuit includes a valve body defining a first fluid path extending between a first inlet port and a first outlet port of the valve body, and defining a second fluid path extending between a second inlet part and a second outlet port of the valve body, and defining a third fluid path fluidly coupling the first and second paths, and including a bypass valve disposed in the third path to control a flow of fluid through the third path, the method including the steps of:

(a) disconnecting the first and second hydraulic lines from the first and second outlet ports of the boom swing control valve;

(b) aligning the first and second inlet ports of the valve body of the swing damping circuit with the first and second outlet ports of the boom swing control valve; and (c) coupling the first and second inlet ports of the valve body of the swing damping circuit to the first and second outlet ports of the boom swing control valve.

11. The method of claim 10, wherein the first and second inlet ports of the valve body of the swing damping circuit are formed in a first generally planar surface of the valve body of the swing damping circuit.

12. The method of claim 11, wherein the first and second outlet ports of the control valve are formed in a second generally planar surface of the valve body of the control valve.

13. The method of claim 12, wherein the step of aligning includes the step of positioning the first and second surfaces into an abutting relationship.

14. A method for retrofitting a backhoe with a boom swing damping circuit, the swing damping circuit including first and second flow restrictors and the backhoe including a boom swing control valve configured to be fluidly coupled to at least one boom swing cylinder by first and second hydraulic lines, the method comprising the steps of:

disconnecting the boom swing control valve from the at least one boom swing cylinder;

fluidly coupling the first and second hydraulic lines to a swing-damping circuit having a bypass valve disposed to conduct fluid between the first and second hydraulic lines;

reconnecting the boom swing control valve to the at least one boom swing cylinder; and the first and second flow restrictors disposed to restrict flow between the boom swing control valve and the at least one boom swing cylinder after the step of reconnecting.

15. A method of retrofitting a backhoe valve assembly with a swing damping circuit, wherein the valve assembly includes at least a boom swing valve section, a boom lift valve section, and a dipper lift valve section, each fluidly coupled by first and second hydraulic lines to at least one boom swing cylinder having an extend and a retract port, at least one boom lift cylinder and at least one dipper lift cylinder, respectively, the method comprising the steps of:

removing the boom swing valve section from the valve assembly; and replacing the boom swing valve section in the valve assembly with a combination boom swing valve and swing damping circuit section, wherein the combination valve section includes:

a valve spool responsive to operator actuation and configured to provide bi-directional flow to the at least one boom swing cylinder through two hydraulic lines; and a swing damping circuit responsive to the deceleration of a backhoe assembly and including a bypass valve configured to provide a fluid flow path that fluidly couples the extend port to the retract port of the at least one boom swing cylinder.

16. The method of claim 15, a further comprising the step of combining the boom swing valve section with the swing damping circuit to thereby create the combination valve section.

17. The method of claim 15, further comprising the step of disconnecting the boom swing valve section from its corresponding first and second hydraulic lines.

18. The method of claim 17, further comprising the step of fluidly coupling the combined valve section to the extend and retract ports of the at least one boom swing cylinder.

19. The method of claim 18, wherein the step of fluidly coupling includes the step of fluidly coupling a first one hydraulic line to a first outlet port of the combined valve section and to the extend port of the at least one boom swing cylinder and fluidly coupling another hydraulic line to a second outlet port of the combined valve section and to the retract port of the at least one boom swing cylinder.

20. The method of claim 15, wherein the bypass valve includes a fluid pressure actuated spool and further wherein the combined valve section includes a unitary valve body housing both an operator actuated directional control valve spool and the fluid pressure actuated spool.

21. The method of claim 20, wherein the unitary valve body is comprised of a first valve body housing the operator actuated directional valve spool and a second valve body fixed to the first valve body and housing the fluid pressure actuated spool.

22. The method of claim 21, wherein the first and second valve bodies are removably coupled to form the unitary valve body.

23. The method of claim 22, wherein the first and second valve bodies are removably coupled by threaded fasteners.

* * * * *